US007341987B2

(12) United States Patent
Wei et al.

(10) Patent No.: US 7,341,987 B2
(45) **Date of Patent: *Mar. 11, 2008**

(54) BINDING AGENT FOR SOLID BLOCK FUNCTIONAL MATERIAL

(75) Inventors: G. Jason Wei, Mendota Heights, MN (US); Steven E. Lentsch, St. Paul, MN (US); Keith E. Olson, Apple Valley, MN (US); Victor F. Man, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 498 days.

This patent is subject to a terminal disclaimer.

(21) Appl. No.: 10/714,836

(22) Filed: Nov. 14, 2003

(65) Prior Publication Data

US 2004/0106535 A1 Jun. 3, 2004

Related U.S. Application Data

(63) Continuation of application No. 09/735,973, filed on Dec. 13, 2000, now Pat. No. 6,653,266, which is a continuation of application No. 08/989,824, filed on Dec. 12, 1997, now Pat. No. 6,258,765, which is a continuation-in-part of application No. 08/781,493, filed on Jan. 13, 1997, now Pat. No. 6,177,392.

(60) Provisional application No. 60/034,931, filed on Jan. 13, 1997.

(51) Int. Cl.
*C11D 17/00* (2006.01)
*C11D 3/10* (2006.01)
*C11D 3/36* (2006.01)

(52) U.S. Cl. ..... 510/445; 510/446; 510/224; 510/233; 510/469; 510/480; 510/509; 510/511

(58) Field of Classification Search ..... 510/445, 510/446, 224, 233, 469, 480, 509, 511
See application file for complete search history.

(56) References Cited

U.S. PATENT DOCUMENTS

| | | | |
|---|---|---|---|
| 1,580,576 | A | 4/1926 | Weidner |
| 1,949,264 | A | 2/1934 | Bagley |
| 2,412,819 | A | 12/1946 | MacMahon |
| 2,920,417 | A | 1/1960 | Wertheimer |
| 2,927,900 | A | 3/1960 | Shiraeff |
| 2,987,483 | A | 6/1961 | Brooker |
| 3,048,548 | A | 8/1962 | Martin et al. |
| 3,052,652 | A | 9/1962 | Halpern et al. |
| 3,277,009 | A | 10/1966 | Freifeld et al. |
| 3,280,037 | A | 10/1966 | Gordon et al. |
| 3,306,858 | A | 2/1967 | Oberle |
| 3,334,147 | A | 8/1967 | Brunelle et al. |
| 3,351,558 | A | 11/1967 | Zimmerer |
| 3,382,178 | A | 5/1968 | Lissant et al. |
| 3,390,092 | A | 6/1968 | Keast et al. |
| 3,390,093 | A | 6/1968 | Feierstein et al. |
| 3,392,121 | A | 7/1968 | Gedge, III |
| 3,441,511 | A | 4/1969 | Otrhalek et al. |
| 3,442,242 | A | 5/1969 | Laskey et al. |
| 3,491,028 | A | 1/1970 | Crotty et al. |
| 3,534,851 | A | 10/1970 | Peterson et al. |
| 3,557,003 | A | 1/1971 | Morris et al. |
| 3,639,286 | A | 2/1972 | Ballestra et al. |
| 3,695,989 | A | 10/1972 | Albert |
| 3,790,482 | A | 2/1974 | Jones et al. |
| 3,816,320 | A | 6/1974 | Corliss |
| 3,846,346 | A | 11/1974 | Conn |
| 3,856,932 | A | 12/1974 | May |
| 3,887,614 | A | 6/1975 | Susuki et al. |
| 3,899,436 | A | 8/1975 | Copeland et al. |
| 3,933,670 | A | 1/1976 | Brill et al. |
| 3,936,386 | A | 2/1976 | Corliss et al. |
| 3,941,710 | A | 3/1976 | Gilbert et al. |
| 3,961,754 | A | 6/1976 | Kuhns et al. |

(Continued)

FOREIGN PATENT DOCUMENTS

DE 28 10 999 9/1978

(Continued)

OTHER PUBLICATIONS

Translation of German Published, Non-Examined Patent Application DE OS 28 10 999, filed under No. 28 10 999.1 on Mar. 14, 1978, and published on Sep. 21, 1978, claiming the priority of British Patent Application 11470-77; Title: Dishwasher Detergent; Applicant: Unilever N.V.; Representative: Dr. F. Lederer; Inventor: Wolfgang Prox.
"Hawley's Condensed Chemical Dictionary", Twelfth Edition, Revised by Richard J. Lewis, Sr., p. 176 (1993).
Office Action mailed Jun. 11, 1998 from U.S. Appl. No. 08/781,493.
Office Action mailed Nov. 24, 1998 from U.S. Appl. No. 08/781,493.
Office Action mailed Jul. 19, 1999 from U.S. Appl. No. 08/781,493.
Office Action mailed Oct. 6, 1999 from U.S. Appl. No. 08/781,493.
Office Action mailed Dec. 9, 1999 from U.S. Appl. No. 08/781,493.
Notice of Allowance mailed Jul. 28, 2000 from U.S. Appl. No. 08/781,493.
Notice of Allowance mailed Sep. 15, 1998 from U.S. Appl. No. 29/082,046.
Office Action mailed Jun. 7, 2002 from U.S. Appl No 09/708,903.
Office Action mailed Dec. 4, 2002 from U.S. Appl. No. 09/708,903.
Notice of Allowance mailed Feb. 12, 2003 from U.S. Appl. No. 09/708,903.
Office Action mailed Dec. 18, 2003 from U.S. Appl. No. 10/431,665.

(Continued)

*Primary Examiner*—Lorna M. Douyon
(74) *Attorney, Agent, or Firm*—Merchant & Gould P.C.

(57) ABSTRACT

A solid functional material comprises a functional agent such as a cleaning composition, a sanitizing agent, where a rinse agent, etc. in a solid block format. The solid block is formed by a binding agent that forms the active ingredients into a solid block. The binding agent comprises a phosphonate or amino acetate sequestrant, a carbonate salt and water in an E-Form hydrate. These materials at a specific mole ratio form a novel binding agent that can form functional materials into a solid matrix form.

22 Claims, 9 Drawing Sheets

U.S. PATENT DOCUMENTS 3,985,669 A 10/1976 Krummel et al.
4,000,080 A 12/1976 Bartolotia et al.
4,046,507 A 9/1977 Zweifel et al.
4,072,621 A 2/1978 Rose
4,083,795 A 4/1978 Joubert
4,105,573 A 8/1978 Jacobsen
4,147,650 A 4/1979 Sabatelli et al.
4,148,603 A 4/1979 Schwuger et al.
4,211,517 A 7/1980 Schmid
4,212,761 A 7/1980 Ciaccio
4,216,125 A 8/1980 Campbell et al.
4,219,436 A 8/1980 Gromer et al.
4,238,345 A 12/1980 Guilbert
4,243,543 A 1/1981 Guilbert et al.
4,261,868 A 4/1981 Hora et al.
4,268,406 A 5/1981 O'Brien et al.
4,274,975 A 6/1981 Corkill et al.
4,276,205 A 6/1981 Ferry
4,284,532 A 8/1981 Leikhim et al.
4,289,815 A 9/1981 Lee
4,329,246 A 5/1982 Gilbert et al.
4,348,293 A 9/1982 Clarke et al.
4,359,413 A 11/1982 Ward et al.
4,416,793 A 11/1983 Barrat et al.
4,426,362 A 1/1984 Copeland et al.
4,474,976 A 10/1984 Faltynek
4,481,167 A 11/1984 Ginter et al.
4,537,706 A 8/1985 Severson, Jr.
4,587,031 A 5/1986 Kruse et al.
4,594,175 A 6/1986 Copeland
4,595,520 A 6/1986 Heile et al.
4,605,509 A 8/1986 Corkill et al.
4,608,187 A 8/1986 Chang
4,608,189 A 8/1986 Koch et al.
4,618,914 A 10/1986 Sato et al.
4,664,848 A 5/1987 Oh et al.
4,677,130 A 6/1987 Puzig
4,680,134 A 7/1987 Heile et al.
4,687,121 A 8/1987 Copeland
4,690,305 A 9/1987 Copeland
4,692,494 A 9/1987 Sonenstein
4,695,284 A 9/1987 Hight
4,698,181 A 10/1987 Lewis
4,715,979 A 12/1987 Moore et al.
4,725,376 A 2/1988 Copeland
4,753,755 A 6/1988 Gansser
RE32,762 E 10/1988 Katzmann et al.
RE32,763 E 10/1988 Fernholtz et al.
RE32,818 E 1/1989 Fernholz et al.
4,826,661 A 5/1989 Copeland et al.
4,830,773 A 5/1989 Olson
4,836,951 A 6/1989 Totten et al.
4,845,965 A 7/1989 Copeland et al.
4,846,993 A 7/1989 Lentsch et al.
4,858,449 A 8/1989 Lehn
4,895,667 A 1/1990 Fox et al.
4,965,012 A 10/1990 Olson
4,983,315 A 1/1991 Glogowski et al.
5,019,292 A 5/1991 Baeck et al.
5,034,147 A 7/1991 Ramachandran
5,061,392 A 10/1991 Bruegge et al.
5,064,561 A 11/1991 Rouillard
5,078,301 A 1/1992 Gladfelter et al.
5,080,819 A 1/1992 Morganson et al.
5,118,426 A 6/1992 Duncan et al.
5,122,538 A 6/1992 Lokkesmoe et al.
5,173,207 A 12/1992 Drapier et al.
5,198,198 A 3/1993 Gladfelter et al.
5,223,179 A 6/1993 Connor et al.
5,234,615 A 8/1993 Gladfelter et al.
5,234,719 A 8/1993 Richter et al.
5,249,737 A 10/1993 Fritz et al.
5,254,287 A 10/1993 Deleeuw et al.
5,290,496 A 3/1994 Carduck et al.
5,292,525 A 3/1994 Brenden et al.
5,312,561 A 5/1994 Hoshino et al.
5,316,688 A 5/1994 Gladfelter et al.
5,328,082 A 7/1994 Fritz et al.
5,358,653 A 10/1994 Gladfelter et al.
5,382,377 A 1/1995 Raehse et al.
5,389,425 A 2/1995 Platt et al.
5,407,700 A 4/1995 Man et al.
5,419,850 A 5/1995 Backes et al.
5,429,766 A 7/1995 Sone et al.
5,447,648 A 9/1995 Steindorf
5,451,336 A 9/1995 Schwadtke et al.
5,474,698 A 12/1995 Rolando et al.
5,494,817 A 2/1996 Chen
5,516,449 A 5/1996 Agar et al.
5,559,089 A 9/1996 Hartman et al.
5,578,134 A 11/1996 Lentsch et al.
5,589,099 A 12/1996 Baum
5,650,017 A 7/1997 Gordon et al.
5,665,694 A 9/1997 Backes et al.
5,691,292 A 11/1997 Marshall et al.
5,763,378 A 6/1998 Painter et al.
5,830,839 A 11/1998 Scepanski
5,858,117 A 1/1999 Oakes et al.
5,858,299 A 1/1999 Fernholz et al.
5,861,366 A 1/1999 Ihns et al.
D406,635 S 3/1999 Russell et al.
5,876,514 A 3/1999 Rolando et al.
5,900,395 A 5/1999 Nicholson et al.
5,990,068 A 11/1999 Brouwer et al.
6,008,174 A 12/1999 Brouwer et al.
6,017,864 A 1/2000 Brittain et al.
6,060,444 A 5/2000 Schulz et al.
6,136,769 A 10/2000 Asano et al.
6,150,324 A 11/2000 Lentsch et al.
6,156,715 A 12/2000 Lentsch et al.
6,177,392 B1 1/2001 Lentsch et al.
6,258,765 B1 7/2001 Wei et al.
6,281,180 B1 8/2001 Tartakovsky et al.
6,410,495 B1 * 6/2002 Lentsch et al. ..... 510/224
6,436,893 B1 8/2002 Lentsch et al.
6,489,278 B1 12/2002 Lentsch et al.
6,503,879 B2 1/2003 Lentsch et al.
6,583,094 B1 * 6/2003 Lentsch et al. ..... 510/224
6,660,707 B2 * 12/2003 Lentsch et al. ..... 510/445
6,831,054 B2 * 12/2004 Lentsch et al. ..... 510/446
7,087,569 B2 * 8/2006 Lentsch et al. ..... 510/445
7,094,746 B2 * 8/2006 Lentsch et al. ..... 510/445
2002/0077264 A1 6/2002 Roberts et al.

FOREIGN PATENT DOCUMENTS

EP 0 161 598 A2 5/1985
EP 0 363 852 A1 4/1990
EP 0 364 840 A1 4/1990
EP 0 501 375 A1 9/1992
EP 0 364 840 B2 3/1996
EP 1 158 016 A2 11/2001
EP 1 158 016 A3 11/2001
GB 687 075 2/1953
GB 1031831 6/1966
GB 1 596 756 8/1981
GB 2 271 120 A 4/1994
GB 2373235 A 9/2002
JP 6-187800 5/1986
JP 9-217100 8/1997
WO WO92/02611 2/1992
WO WO92/13061 8/1992
WO WO92/17382 10/1992
WO WO93/21299 10/1993

| | | | |
|---|---|---|---|
| WO | WO95/18215 | | 7/1995 |
| WO | WO96/06910 | | 3/1996 |
| WO | WO96/08555 | | 3/1996 |
| WO | WO96/41859 | | 12/1996 |
| WO | WO97/02753 | | 1/1997 |
| WO | WO97/05226 | | 2/1997 |
| WO | WO97/07190 | | 2/1997 |
| WO | WO98/54285 | | 12/1998 |
| WO | WO 00/64667 | | 11/2000 |
| WO | WO 02/32780 | A2 | 4/2002 |
| WO | WO 02/32780 | A3 | 4/2002 |

OTHER PUBLICATIONS

Notice of Allowance mailed Jul. 30, 2004 from U.S. Appl. No. 10/431,665.
Office Action mailed Apr. 19, 2005 from U.S. Appl. No. 11/009,315.
Office Action mailed Nov. 18, 2005 from U.S. Appl. No. 11/009,315.
Notice of Allowance mailed Feb. 22, 2006 from U.S. Appl. No. 11/009,315.
Office Action dated Mar. 30, 1999 from U.S. Appl. No. 08/989,824.
Notice of Allowance dated Feb. 5, 2001 from U.S. Appl. No. 08/989,824.
Office Action dated Aug. 6, 1998 from U.S. Appl. No. 08/782,457.
Office Action dated May 28, 1999 from U.S. Appl. No. 08/782,457.
Office Action dated Mar. 8, 2000, from U.S. Appl. No. 08/782,457.
Notice of Allowance dated Jun. 27, 2007 from U.S. Appl. No. 08/782,457.
Office Action dated Mar. 6, 2001 from U.S. Appl. No. 09/691,012.
Office Action dated Oct. 16, 2001 from U.S. Appl. No. 09/691,012.
Notice of Allowance dated Apr. 19, 2002 from U.S. Appl. No. 09/691,012.
Office Action dated Jan. 30, 2003 from U.S. Appl. No. 09/735,973.
Notice of Allowance dated Jun. 2, 2003 from U.S. Appl. No. 09/735,973.
Supplemental Notice of Allowance dated Jul 16, 2003 from U.S. Appl. No. 09/736,973.
Office Action dated Aug. 2, 2001 from Appl. No. 09/809,459.
Office Action dated Mar. 27, 2002 from Appl. No. 09/809,459.
Notice of Allowance dated Aug. 21, 2002 from U.S. Appl. No. 09/809,459.
Office Action dated Dec. 16, 2003 from U.S. Appl. No. 10/338,144.
Notice of Allowance dated Aug. 25, 2004 from U.S. Appl. No. 10/338,144.
Office Action dated Jan. 12, 2004 from U.S. Appl. No. 10/384,251.
Office Action dated Mar. 3, 2005 from U.S. Appl. No. 10/384,251.
Advisory Action dated Sep. 16, 2005 from U.S. Appl. No. 10/384,251.
Office Action dated Dec. 1, 2005 from U.S. Appl. No. 10/384,251.
Office Action dated Jun. 16, 2006 from U.S. Appl. No. 10/384,251.
Office Action dated Dec. 29, 2006 from U.S. Appl. No. 10/384,251.
Office Action dated Nov. 2, 2005 from U.S. Appl. No. 11/021,529.
Office Action dated Apr. 19, 2006 from U.S. Appl. No. 11/021,529.
Office Action dated Dec. 18, 2006 from U.S. Appl. No. 11/021,529.
Office Action dated Jun. 1, 2007 from U.S. Appl. No. 11/021,529.
Office Action dated Aug. 22, 2007 from U.S. Appl. No. 10/384,251.

* cited by examiner

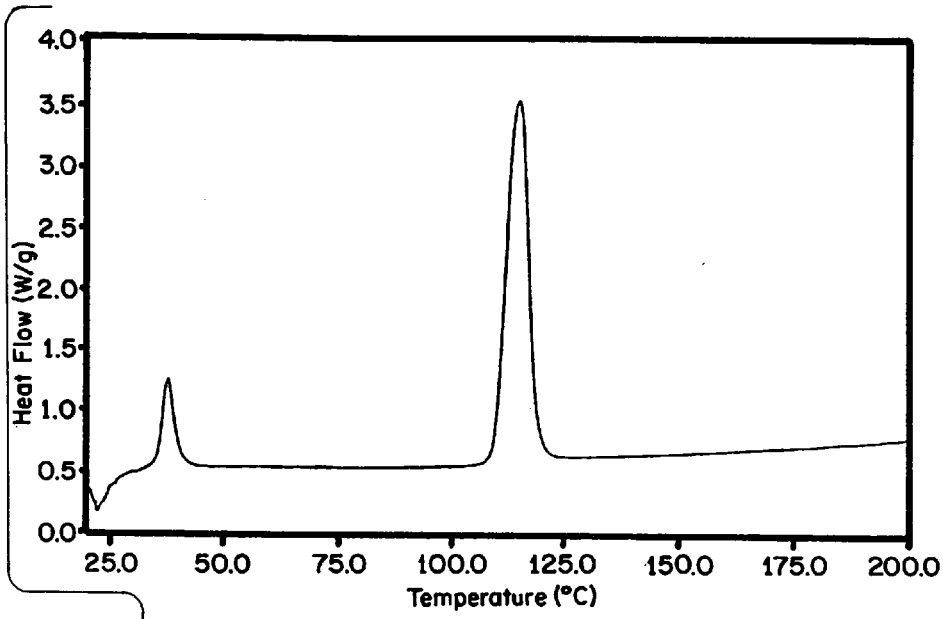
FIG. 1
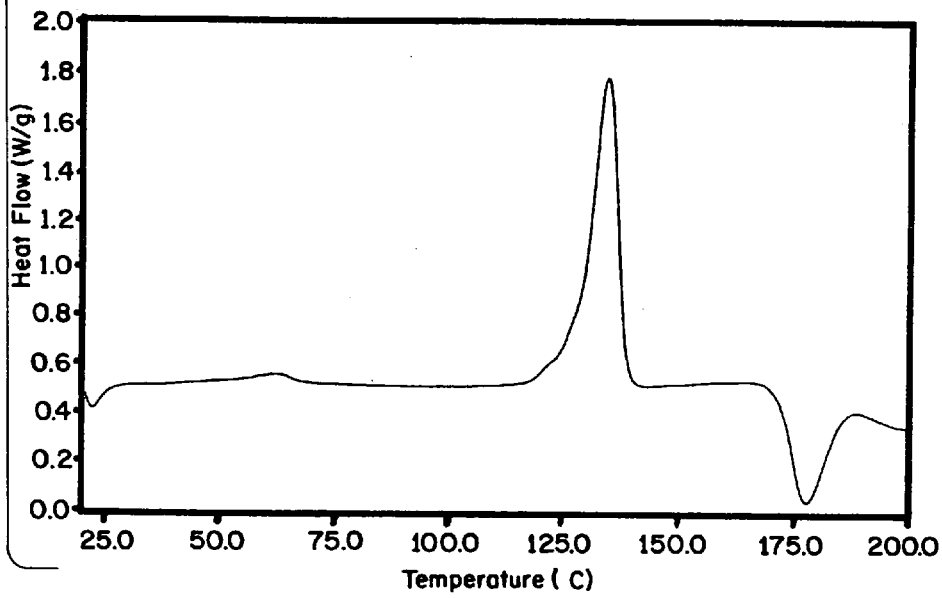

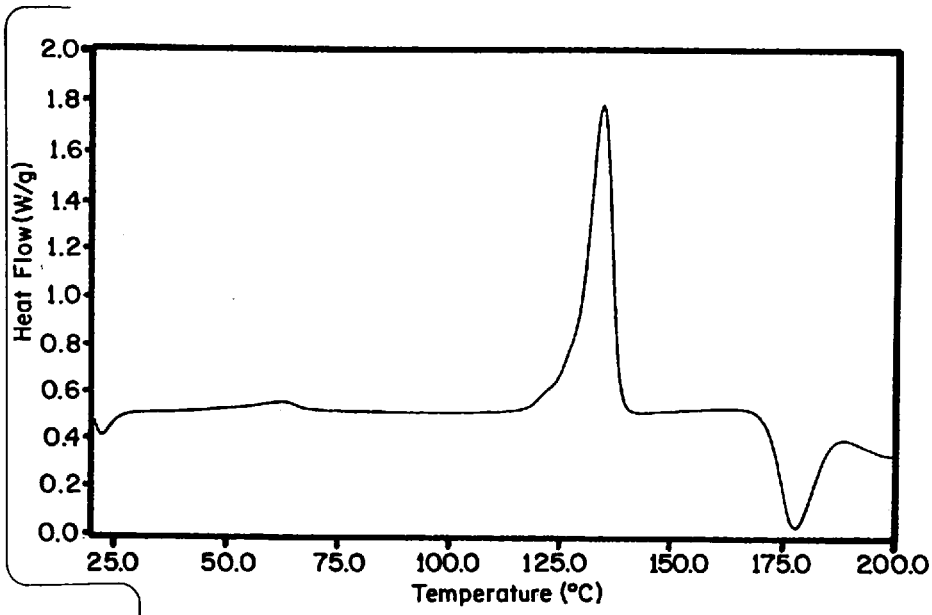
FIG. 2
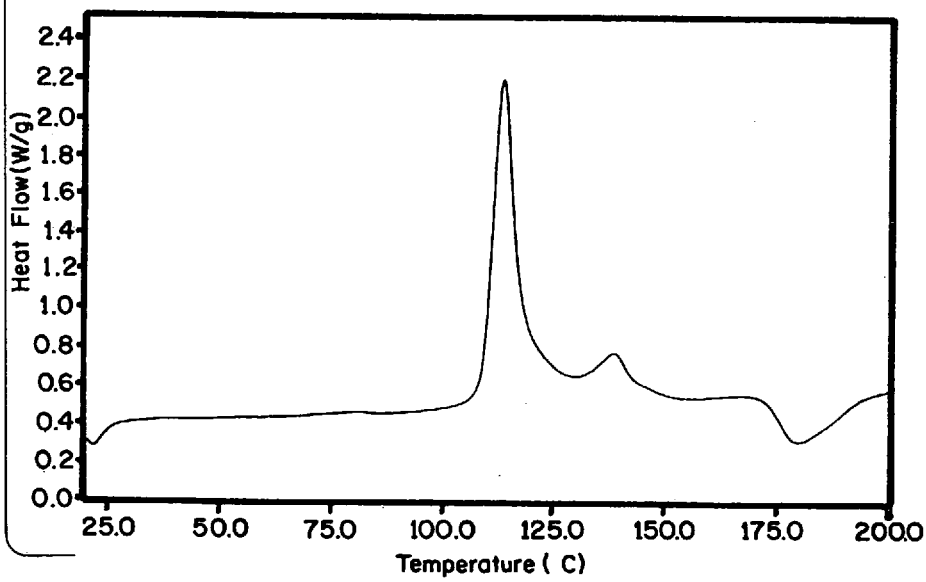

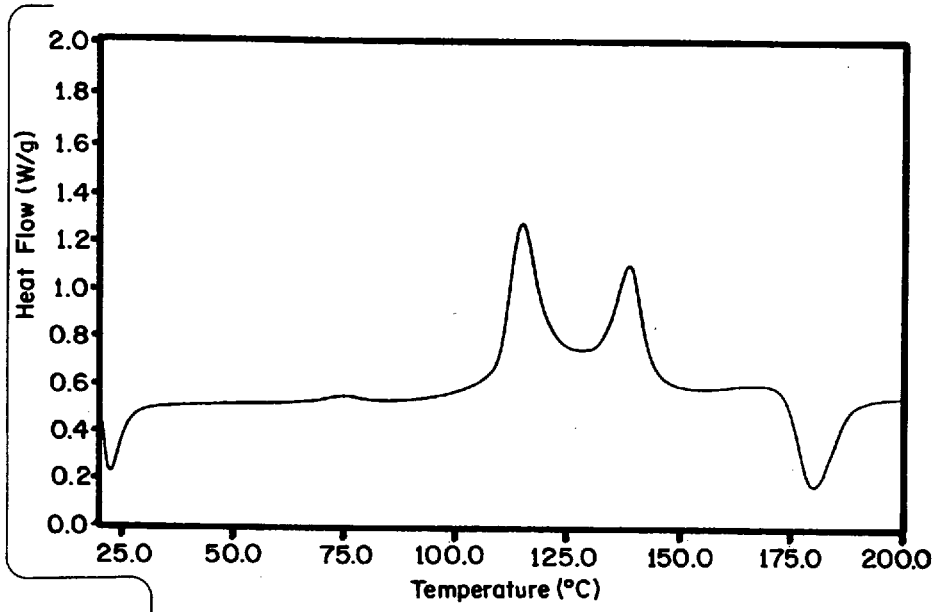
FIG. 3
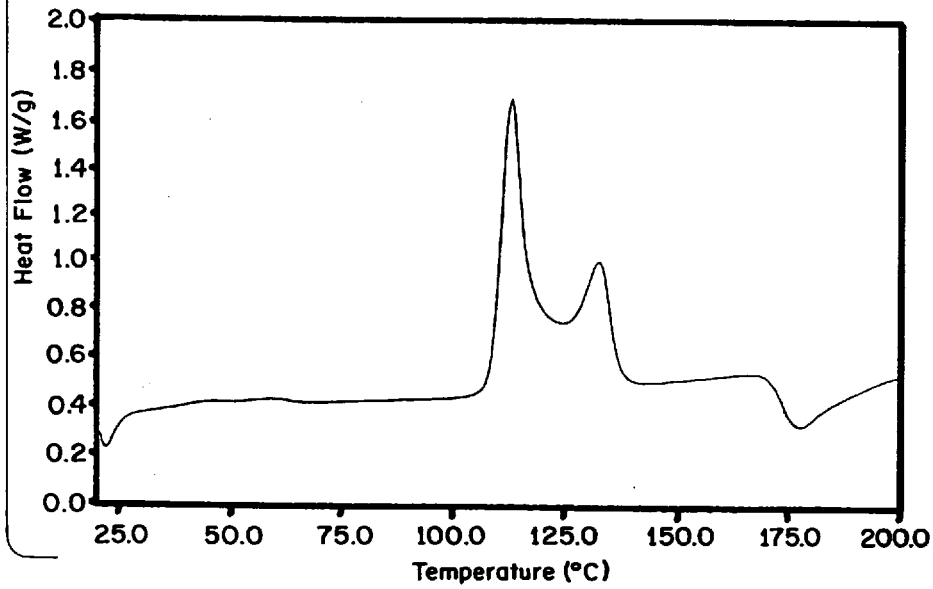

BINDING AGENT FOR SOLID BLOCK FUNCTIONAL MATERIAL

This application is a Continuation of application Ser. No. 09/735,973, filed Dec. 13, 2000, now US Pat. No. 6,653,266, which is a Continuation of application Ser. No. 08/989,824, filed Dec. 12,1997, now US Pat. No. 6,258,765, which is a Continuation-In-Part of application Ser. No. 08/781,493, filed Jan. 13, 1997, now US Patent No. 6,177,392, and which claims benefit of Provisional application 60/034,931, filed Jan. 13, 1997.

FIELD OF THE INVENTION

The invention relates to a novel binding agent that is used to bind functional materials that can be manufactured in the form of a solid block. The solid, water soluble or dispersible functional material is typically dispensed using a spray-on dispenser which dissolves the solid block creating an aqueous concentrate of the functional material at a useful concentration. The aqueous concentrate is directed to a use locus. The term "functional material" refers to a warewashing or laundry detergent or other active compound or material that when dissolved or dispersed in an aqueous phase can provide a beneficial property to the aqueous material when used in a use locus.

BACKGROUND OF THE INVENTION

The use of solidification technology and solid block detergents in institutional and industrial operations was pioneered in the SOLID POWER® brand technology claimed in Fernholz et al., U.S. Reissue Pat. Nos. 32,762 and 32,818. Additionally, sodium carbonate hydrate cast solid products using substantially hydrated sodium carbonate materials was disclosed in Heile et al., U.S. Pat. Nos. 4,595,520 and 4,680,134. In recent years attention has been directed to producing highly effective detergent materials from less caustic materials such as soda ash also known as sodium carbonate. Early work in developing the sodium carbonate based detergents found that sodium carbonate hydrate based materials swelled, (i.e., were dimensionally unstable after solidification). Such swelling can interfere with packaging, dispensing and use. The dimensional instability of the solid materials relates to the unstable nature of various hydrate forms prepared in manufacturing the sodium carbonate solid materials. Early products made from hydrated sodium carbonate typically comprised a one mole hydrate, a seven mole hydrate, a ten mole hydrate or more typically mixtures thereof. After manufacture, upon storage at ambient temperatures, the hydration state of the initial product was found to change. Often this change involved a change from a dense hydrate to a less dense hydrate and resulting in an increase in volume of the block product. This hydrate change was believed to be the cause of the dimensional instability of the block chemicals. Substantial efforts were made to forming a solid comprising a one mole hydrate that was chemically and dimensionally stable. Substantial success was achieved in this research and development project. However, further work was directed to both the chemistry and processes involved in cast solid block manufacture. Detailed experimentation was directed to different compositions that could be used in manufacturing sodium carbonate detergents. Further, significant process studies were initiated to develop improved process parameters in manufacturing solid block detergents.

A variety of investigative programs were initiated to explore the parameters of solid block detergent manufacturing using casting and extrusion technology. The economics, processability, utility and product stability of the solid products were continually investigated to obtain improvements over quality and useful products.

BRIEF DISCUSSION OF THE INVENTION

In the past, solid block detergents were solidified using a freezing of a low melting point sodium hydroxide hydrate, by using a thermoplastic organic or inorganic solidifying agent or through other mechanisms. We have found that this solids technology can be extended to materials other than detergent and that an improved solid block functional material can be made using a binding agent that is intentionally prepared in the solidifying mix. The binding agent comprises a carbonate salt, an organic acetate or phosphonate component and water in a binder material we have identified as the E-form hydrate. In the E-form hydrate binder for each mole of organic phosphonate or amino acetate there is about 3 to 10 molar parts of alkali metal carbonate monohydrate and 5 to 15 molar parts of water based on the binder weight. This hydrate has not been formed to date in previous carbonate materials.

In our experimentation with respect to the use of organic phosphonate sequestrants in sodium carbonate solid block detergents, conclusive evidence for the existence of the hydration complex has been found and distinguished form earlier carbonate detergents. The new complex comprises an alkali metal carbonate, an organic phosphonate sequestrant and water. This complex is distinctly different from typical sodium carbonate monohydrate, or higher hydrate forms ($Na_2CO_3.xH_2O$, wherein x ranges from 1 to 10). In the manufacture of prior art carbonate containing solid block detergent, the most useful solidifying agent comprises sodium carbonate monohydrate. We have found that a solid block detergent can be manufactured comprising sodium carbonate, an organic phosphonate or acetate, less than about 1.3 moles of water per each mole of sodium carbonate and other optional ingredients including nonionic surfactants, defoamers, chlorine sources. Under these conditions, a unique cast solid block functional material is manufactured from a mixture of ingredients having both hydrated sodium carbonate and non-hydrated sodium carbonate. The mixture is formed into a solid block using a hydration complex comprising a portion of the sodium carbonate, the organic phosphonate or acetate sequestrant and water. The majority of water forms carbonate monohydrate within the overall complex. The complex appears to be a substantially amorphous material substantially free of crystalline structure as shown in x-ray crystallographic studies. The material solidified by the complex is in large part, about 10 to 85 wt. %, $Na_2CO_3.H_2O$ (monohydrate). Less than about 25 wt. %, preferably about 0.1 to 15 wt. % anhydrous carbonate.

The E-form hydrate acts as a binder material or binding agent dispersed throughout the solid containing the ingredients that provide the functional material and desired properties. The solid block detergent uses a substantial proportion, sufficient to obtain functional properties, of an active ingredient such as a detergent, a lubricant, a sanitizer, a surfactant, etc. and a hydrated carbonate and non-hydrated carbonate formed into solid in a novel structure using a novel E-form binder material in a novel manufacturing process. The solid integrity of the functional material, comprising anhydrous carbonate and other cleaning compositions, is maintained by the presence of the E-form binding component comprising carbonate, an organic phosphonate or acetate, substantially all water added to the detergent system (an associated fraction of the carbonate forms with the complex). This E-form hydrate binding component is distributed throughout the solid and binds hydrated carbonate and non-hydrated carbonate and other detergent components into a stable solid block detergent.

The alkali metal carbonate is used in a formulation that additionally can include an effective amount of a hardness sequestering agent that both sequesters hardness ions such as calcium, magnesium and manganese but also provides soil removal and suspension properties. The formulations can also contain a surfactant system that, in combination with the sodium carbonate and other components, effectively removes soils at typical use temperatures and concentrations. The block structure can also contain other common additives such as surfactants, builders, thickeners, soil anti-redeposition agents, enzymes, chlorine sources, oxidizing or reducing bleaches, defoamers, rinse aids, dyes, perfumes, etc.

Such block functional materials are preferably substantially free of a component that can compete with the alkali metal carbonate for water of hydration and interfere with solidification. The most common interfering material comprises a second source of alkalinity. The detergent preferably contains less than a solidification interfering amount of the second alkaline source, and can contain less than 5 wt. %, preferably less than 4 wt. %, of common alkalinity sources including either sodium hydroxide or an alkaline sodium silicate wherein the ratio $Na_2O:SiO_2$ is about 2:1 to 1:1. While some small proportion sodium hydroxide can be present in the formulation to aid in performance, the presence of a substantial amount of sodium hydroxide can interfere with solidification. Sodium hydroxide preferentially binds water in these formulations and in effect prevents water from participating in the formation of the E-form hydrate binding agent and in solidification of the carbonate. On mole for mole basis, the solid detergent material contains greater than 5 moles of sodium carbonate for each total mole of both sodium hydroxide and sodium silicate.

We have found that a highly effective solid material can be made with little water (i.e. less than 11.5 wt. %, preferably less than 10 wt. % water) based on the block. The solid detergent compositions of Fernholz et al. required depending on composition, a minimum of about 12-15 wt. % of water of hydration for successful processing. The Fernholz solidification process requires water to permit the materials to fluid flow or melt flow sufficiently when processed or heated such that they can be poured into a mold such as a plastic bottle or capsule for solidification. At lesser amounts of water, the material would be too viscous to flow substantially for effective product manufacture. However, the carbonate based materials can be made in extrusion methods with little water. We have found that as the materials are extruded, the water of hydration tends to associate with the phosphonate component and, depending on conditions, a fraction of the anhydrous sodium carbonate used in the manufacture of the materials. If added water associates with other materials such as sodium hydroxide or sodium silicates, insufficient solidification occurs leaving a product resembling slush, paste or mush like a wet concrete. We have found that the total amount of water present in the solid block detergents of the invention is less than about 11 to 12 wt. % water based on the total chemical composition (not including the weight of the container). The preferred solid functional material comprises less than about 1.5, more preferably about 0.9 to 1.3 moles of water per each mole of carbonate. With this in mind for the purpose of this patent application, water of hydration recited in these claims relates primarily to water added to the composition that primarily hydrates and associates with the binder comprising a fraction of the sodium carbonate, the phosphonate and water of hydration. A chemical with water of hydration that is added into the process or products of this invention wherein the hydration remains associated with that chemical (does not dissociate from the chemical and associate with another) is not counted in this description of added water of hydration.

A hard dimensionally stable solid detergents will comprise about 5 to 20 wt. %, preferably 10 to 15 wt. % anhydrous carbonate. The balance of the carbonate comprises carbonate monohydrate. Further, some small amount of sodium carbonate monohydrate can be used in the manufacture of the detergent, however, such water of hydration is used in this calculation.

For the purpose of this application the term "solid block" includes extruded pellet materials having a weight of 50 grams up through 250 grams, an extruded solid with a weight of about 100 grams or greater or a solid block detergent having a mass between about 1 and 10 kilograms. These detergents can be used in both laundry and warewashing. Laundry detergents can include surfactants, brighteners, softeners and other compositions not used in warewashing.

BRIEF DESCRIPTION OF THE DRAWINGS

FIGS. 1 to 8 exhibit thermal data, photographic evidence and a phase diagram that demonstrate the existence of and characterize the E-Form hydrate, the difference between this E-Form hydrate and conventional carbonate hydrates and also show useful hydrate properties.

DETAILED DESCRIPTION OF THE INVENTION

Figure 4:
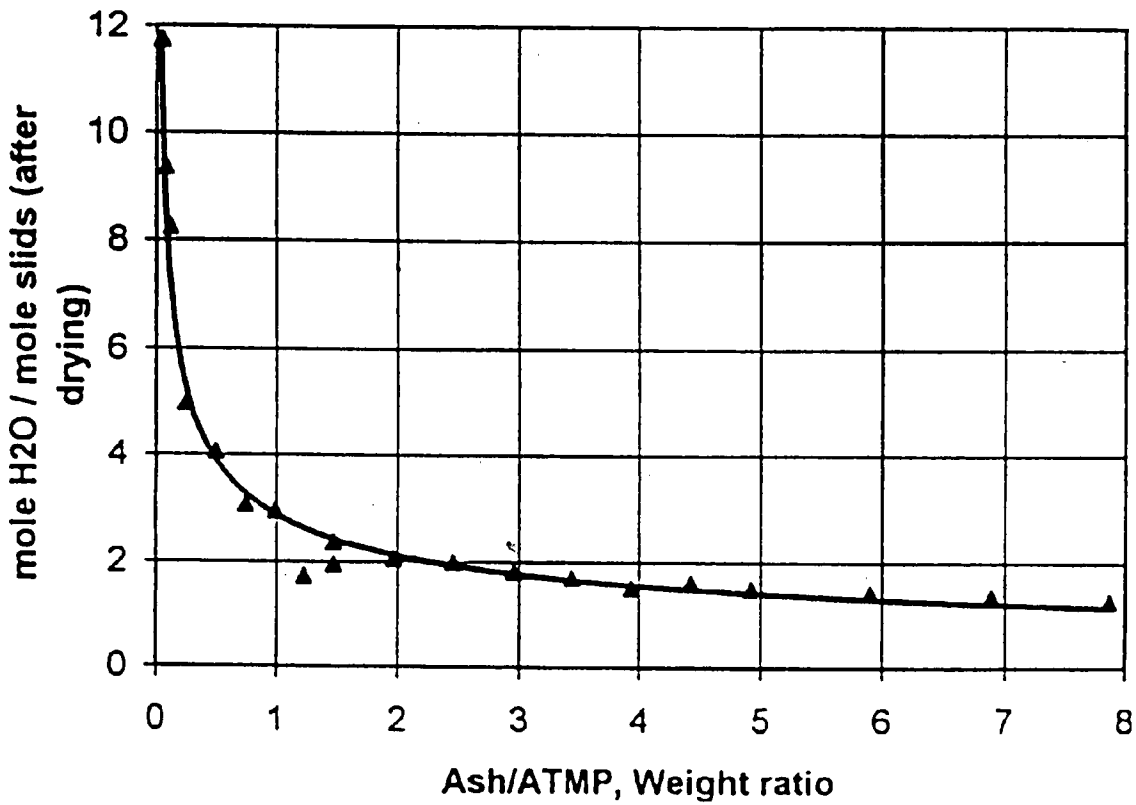

The solid block functional materials of the invention can comprise an alkaline detergent, a surfactant, a lubricant, a rinse agent, a sanitizing agent, a source of alkalinity, and an E-form binding agent comprising the carbonate/phosphonate/water complex.

Active Ingredients

The present method is suitable for preparing a variety of solid cleaning compositions, as for example, a cast solid, an extruded pellet, extruded block, etc., functional compositions. The functional formulations or compositions of the invention comprise a conventional functional agent and other active ingredients that will vary according to the type of composition being manufactured in a solid matrix formed by the binding agent.

The Binding Agent

The essential ingredients in the binding agent are as follows:

Binding Agent Composition Mole Ratios of Materials (Based on Binding Agent Total Weight)

| Chemical | Range of Molar Equivalents in the binder |
|---|---|
| Organo-Phosphonate; or organo amino acetate-Sequestrant | 1 mole |
| Water | 5-15 moles per mole of sequestrant |
| Alkali Metal Carbonate Monohydrate | 3-10 moles per mole of sequestrant |

The sequestrant can be present at amounts of about 0.1 to 70 wt. %, preferably 5 to 60 wt. % of the solid block. As this material solidifies, a single E-form binder composition forms to bind and solidify the detergent components. A portion of the ingredients associate to form the binder while the balance of the ingredients forms the solid block. This hydrate binder is not a simple hydrate of the carbonate component. We believe the solid detergent comprises a major proportion of carbonate monohydrate, a portion of non-hydrated (substantially anhydrous) alkali metal carbonate and the E-form binding agent composition comprising a fraction of the carbonate material, an amount of the organophosphonate and water of hydration. The E-Form hydrate complex has a melting transition of 120-160° C.

The typical solid functional material comprises a functional component and a binding agent. The binding agent typically comprises a carbonate salt, a sequestrant comprising an organic phosphonate or an amino acetate and water. Preferred carbonate salts comprise alkali metal carbonates such as sodium or potassium carbonate. Organic phosphonates that are useful in the E-Form hydrate of the invention include 1-hydroxyethane-1,1-diphosphonic acid, aminotrimethylene phosphonic acid, diethylenetriaminepenta(methylenephosphonic acid) and other similar organic phosphonates. These materials are well known sequestrants but have not been reported as components in a solidification complex material. The complex can alternatively comprise an aminocarboxylic acid type sequestrant in the E-Form complex. Useful aminocarboxylic acid materials include, for example, N-hydroxyethylaminodiacetic acid, an hydroxyethylenediaminetetraacetic acid, diethylenetriaminepentaacetic acid and other similar acids having an amino group with a carboxylic acid substituent. The composition includes a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. Preferably, a cleaning composition includes about 0.1-70 wt. %, preferably from about 5-60 wt. %, of a chelating/sequestering agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$; aminotri(methylenephosphonic acid) $N[CH_2PO(OH)_2]_3$; aminotri(methylenephosphonate), sodium salt $$\begin{array}{l} O^-Na^+ \\ | \\ POCH_2N[CH_2PO(ONa)_2]_2; \\ | \\ OH \end{array}$$

2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_2P_4$ (x=6); bis(hexamethylene)triamine(pentamethylenephosphonic acid) $(HO_2)POCH_2N[(CH_2)_6N[CH_2PO(OH)_2]_2]_2$; and phosphorus acid $H_3PO_3$. A preferred phosphonate combination is ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred.

Other sequestrants are useful for only sequestering properties. Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

Polymeric polycarboxylates suitable for use as sequestering agents in the functional materials of the invention have pendant carboxylate ($—CO_2$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology*, Third Edition, volume 5, pages 339-366 and volume 23, pages 319-320, the disclosure of which is incorporated by reference herein.

Functional Materials

For the purpose of this application, the term "functional materials" include a material that when dispersed or dissolved in an aqueous solution provides a beneficial property in a particular use locus. Examples of such a functional material include organic and inorganic detergents, lubricant compositions, sanitizing compositions, rinse aid compositions, etc.

Inorganic Detergents or Alkaline Sources

The cleaning composition produced according to the invention may include minor but effective amounts of one or more alkaline sources to enhance cleaning of a substrate and improve soil removal performance of the composition. The alkaline matrix is bound into a solid due to the presence of the binder hydrate composition including its water of hydration. The composition comprises about 10-80 wt. %, preferably about 15-70 wt. % of an alkali metal carbonate source, most preferably about 20-60 wt. %.

Organic Detergents, Surfactants or Cleaning Agents

The composition can comprises at least one cleaning agent which is preferably a surfactant or surfactant system. A variety of surfactants can be used in a cleaning composition, including anionic, nonionic, cationic, and zwitterionic surfactants, which are commercially available from a number of sources. Anionic and nonionic agents are preferred. For a discussion of surfactants, see Kirk-Othmer,

*Encyclopedia of Chemical Technology*, Third Edition, volume 8, pages 900-912. Preferably, the cleaning composition comprises a cleaning agent in an amount effective to provide a desired level of cleaning, preferably about 0-20 wt. %, more preferably about 1.5-15 wt. %.

Anionic surfactants useful in the present cleaning compositions, include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, and fatty alcohol sulfates.

Nonionic surfactants useful in cleaning compositions, include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC (BASF-Wyandotte), and the like; and other like nonionic compounds. Silicone surfactants such as the ABIL B8852 can also be used.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethl -hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, a naphthalene-substituted quaternary ammonium chloride such as dimethyl-1-naphthylmethylammonium chloride, and the like; and other like cationic surfactants.

Other Additives

Solid cleaning compositions made according to the invention may further include conventional additives such as a chelating/sequestering agent, bleaching agent, alkaline source, secondary hardening agent or solubility modifier, detergent filler, defoamer, anti-redeposition agent, a threshold agent or system, aesthetic enhancing agent (i.e., dye, perfume), and the like. Adjuvants and other additive ingredients will vary according to the type of composition being manufactured.

Sanitizers

Sanitizing agents also known as antimicrobial agents are chemical compositions that can be used in a solid block functional material to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into a solid functional material that when diluted and dispensed using an aqueous stream forms an aqueous disinfectant or sanitizer composition that can be contacted with a variety of surfaces resulting in prevention of growth or the killing of a substantial proportion of the microbial population. A five fold reduction of the microbial population results in a sanitizer composition. Common antimicrobial agents include phenolic antimicrobials such as pentachlorophenol, orthophenylphenol. Halogen containing antibacterial agents include sodium trichloroisocyanurate, iodine-poly(vinylpyrolidinonen) complexes, bromine compounds such as 2-bromo-2-nitropropane-1,3-diol quaternary antimicrobial agents such as benzalconium chloride, cetylpyridiniumchloride, amine and nitro containing antimicrobial compositions such as hexahydro-1,3,5-tris (2-hydroxyethyl)-s-triazine, dithiocarbamates such as sodium dimethyldithiocarbamate, and a variety of other materials known in the art for their microbial properties.

Rinse Aid Functional Materials

Functional materials of the invention can comprise a formulated rinse aid composition containing a wetting or sheeting agent combined with other optional ingredients in a solid block made using the hydrate complex of the invention. The rinse aid components of the cast solid rinse aid of the invention is a water soluble or dispersible low foaming organic material capable of reducing the surface tension of the rinse water to promote sheeting action and to prevent spotting or streaking caused by beaded water after rinsing is complete in warewashing processes. Such sheeting agents are typically organic surfactant like materials having a characteristic cloud point. The cloud point of the surfactant rinse or sheeting agent is defined as the temperature at which a 1 wt. % aqueous solution of the surfactant turns cloudy when warmed. Since there are two general types of rinse cycles in commercial warewashing machines, a first type generally considered a sanitizing rinse cycle uses rinse water at a temperature of about 180° F., about 80° C. or higher. A second type of non-sanitizing machines uses a lower temperature non-sanitizing rinse, typically at a temperature of about 125° F., about 50° C. or higher. Surfactants useful in these applications are aqueous rinses having a cloud point greater than the available hot service water. Accordingly, the lowest useful cloud point measured for the surfactants of the invention is approximately 40° C. The cloud point can also be 60° C. or higher, 70° C. or higher, 80° C. or higher, etc., depending on the use locus hot water temperature and the temperature and type of rinse cycle. Preferred sheeting agents, typically comprise a polyether compound prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Such sheeting agents have a molecular weight in the range of about 500 to 15,000. Certain types of (PO)(EO) polymeric rinse aids have been found to be useful containing at least one block of poly(PO) and at least one block of poly(EO) in the polymer molecule. Additional blocks of poly(EO), poly PO or random polymerized regions can be formed in the molecule. Particularly useful polyoxypropylene polyoxyethylene block copolymers are those comprising a center block of polyoxypropylene units and blocks of polyoxyethylene units to each side of the center block. Such polymers have the formula shown below:

$$(EO)_n—(PO)_m—(EO)_n$$

wherein n is an integer of 20 to 60, each end is independently an integer of 10 to 130. Another useful block copolymer are block copolymers having a center block of polyoxyethylene units and blocks of polyoxypropylene to each side of the center block. Such copolymers have the formula:

$$(PO)_n—(EO)_m—(PO)_n$$

wherein m is an integer of 15 to 175 and each end are independently integers of about 10 to 30. The solid functional materials of the invention can often use a hydrotrope to aid in maintaining the solubility of sheeting or wetting agents. Hydrotropes can be used to modify the aqueous solution creating increased solubility for the organic material. Preferred hydrotropes are low molecular weight aromatic sulfonate materials such as xylene sulfonates and dialkyldiphenyl oxide sulfonate materials.

Bleaching agents for use in inventive formulations for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the present cleaning compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1-10 wt. %, preferably about 1-6 wt. %.

Detergent Builders or Fillers

A cleaning composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$-$C_{10}$ alkylene glycols such as propylene glycol, and the like. Preferably, a detergent filler is included in an amount of about 1-20 wt. %, preferably about 3-15 wt. %.

Defoaming Agents

A minor but effective amount of a defoaming agent for reducing the stability of foam may also be included in the present cleaning compositions. Preferably, the cleaning composition includes about 0.0001-5 wt. % of a defoaming agent, preferably about 0.01-3 wt. %.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agents

A cleaning composition may also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A cleaning composition may include about 0.5-10 wt. %, preferably about 1-5 wt. %, of an anti-redeposition agent.

Optical Brighteners

Optical brightener is also referred to as fluorescent whitening agents or fluorescent brightening agents provide optical compensation for the yellow cast in fabric substrates. With optical brighteners yellowing is replaced by light emitted from optical brighteners present in the area commensurate in scope with yellow color. The violet to blue light supplied by the optical brighteners combines with other light reflected from the location to provide a substantially complete or enhanced bright white appearance. This additional light is produced by the brightener through fluorescence. Optical brighteners absorb light in the ultraviolet range 275 through 400 nm. and emit light in the ultraviolet blue spectrum 400-500 nm.

Fluorescent compounds belonging to the optical brightener family are typically aromatic or aromatic heterocyclic materials often containing condensed ring system. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.). The choice of optical brighteners for use in detergent compositions will depend upon a number of factors, such as the type of detergent, the nature of other components present in the detergent composition, the temperature of the wash water, the degree of agitation, and the ratio of the material washed to the tub size. The brightener selection is also dependent upon the type of material to be cleaned, e.g., cottons, synthetics, etc. Since most laundry detergent products are used to clean a variety of fabrics, the detergent compositions should contain a mixture of brighteners which are effective for a variety of fabrics. It is of course necessary that the individual components of such a brightener mixture be compatible.

Optical brighteners useful in the present invention are commercially available and will be appreciated by those skilled in the art. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6membered ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as CIS-jasmine orjasmal, vanillin, and the like.

Other Ingredients

A wide variety of other ingredients useful in detergent compositions can be included in the compositions hereof, including other active ingredients, builders, carriers, processing aids, dyes or pigments, perfumes, solvents for liquid formulations, hydrotropes (as described below), etc. Liquid detergent compositions can contain water and other solvents. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g., propylene glycol, ethylene glycol, glycerine, and 1,2-propanediol) can also be used.

The presoak compositions hereof will preferably be formulated such that during use in aqueous cleaning operations the wash water will have a pH of between about 6.5 and about 11, preferably between about 7.5 and about 10.5. Liquid product formulations preferably have a (10% dilution) pH between about 7.5 and about 10.0, more preferably between about 7.5 and about 9.0 Techniques for controlling pH at recommended usage levels include the use of buffers, alkali, acids, etc., and are well known to those skilled in the art.

Aqueous Medium

The ingredients may optionally be processed in a minor but effective amount of an aqueous medium such as water to achieve a homogenous mixture, to aid in the solidification, to provide an effective level of viscosity for processing the mixture, and to provide the processed composition with the desired amount of firmness and cohesion during discharge and upon hardening. The mixture during processing typically comprises about 0.2-12 wt. % of an aqueous medium, preferably about 0.5-10 wt. %.

We have also found that the unique binding agent of the invention can be used to form solid functional materials other than detergents. We have found that the active ingredients in sanitizing agents, rinse agents, aqueous lubricants, and other functional materials can be formed in a solid format using the binding agents of the invention. Such materials are combined with sufficient amounts of alkali metal carbonate hydrate, organic sequestrant and water to result in a stable solid block material.

Processing of the Composition

The invention provides a method of processing a solid cleaning composition. According to the invention, a functional agent and optional other ingredients are mixed with an effective solidifing amount of ingredients in an aqueous medium. A minimal amount of heat may be applied from an external source to facilitate processing of the mixture.

A mixing system provides for continuous mixing of the ingredients at high shear to form a substantially homogeneous liquid or semi-solid mixture in which the ingredients are distributed throughout its mass. Preferably, the mixing system includes means for mixing the ingredients to provide shear effective for maintaining the mixture at a flowable consistency, with a viscosity during processing of about 1,000-1,000,000 cP, preferably about 50,000-200,000 cP. The mixing system is preferably a continuous flow mixer or more preferably, a single or twin screw extruder apparatus, with a twin-screw extruder being highly preferred.

The mixture is typically processed at a temperature to maintain the physical and chemical stability of the ingredients, preferably at ambient temperatures of about 20-80° C., more preferably about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

The ingredients are mixed to form a substantially homogeneous consistency wherein the ingredients are distributed substantially evenly throughout the mass. The mixture is then discharged from the mixing system through a die or other shaping means. The profiled extrudate then can be divided into useful sizes with a controlled mass. Preferably, the extruded solid is packaged in film. The temperature of the mixture when discharged from the mixing system is preferably sufficiently low to enable the mixture to be cast or extruded directly into a packaging system without first cooling the mixture. The time between extrusion discharge and packaging may be adjusted to allow the hardening of the detergent block for better handling during further processing and packaging. Preferably, the mixture at the point of discharge is about 20-90° C., preferably about 25-55° C. The composition is then allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The composition eventually hardens due to the chemical reaction of the ingredients forming the E-form hydrate binder. The solidification process may last from a few minutes to about six hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 1 minute to about 2 hours, preferably about 1 minute to about 20 minutes.

Packaging System

The packaging receptacle or container may be rigid or flexible, and composed of any material suitable for containing the compositions produced according to the invention, as for example glass, metal, plastic film or sheet, cardboard, cardboard composites, paper, and the like.

Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. Preferred packaging used to contain the compositions is manufactured from a flexible, easy opening film material.

Dispensing of the Processed Compositions

Figure 9:
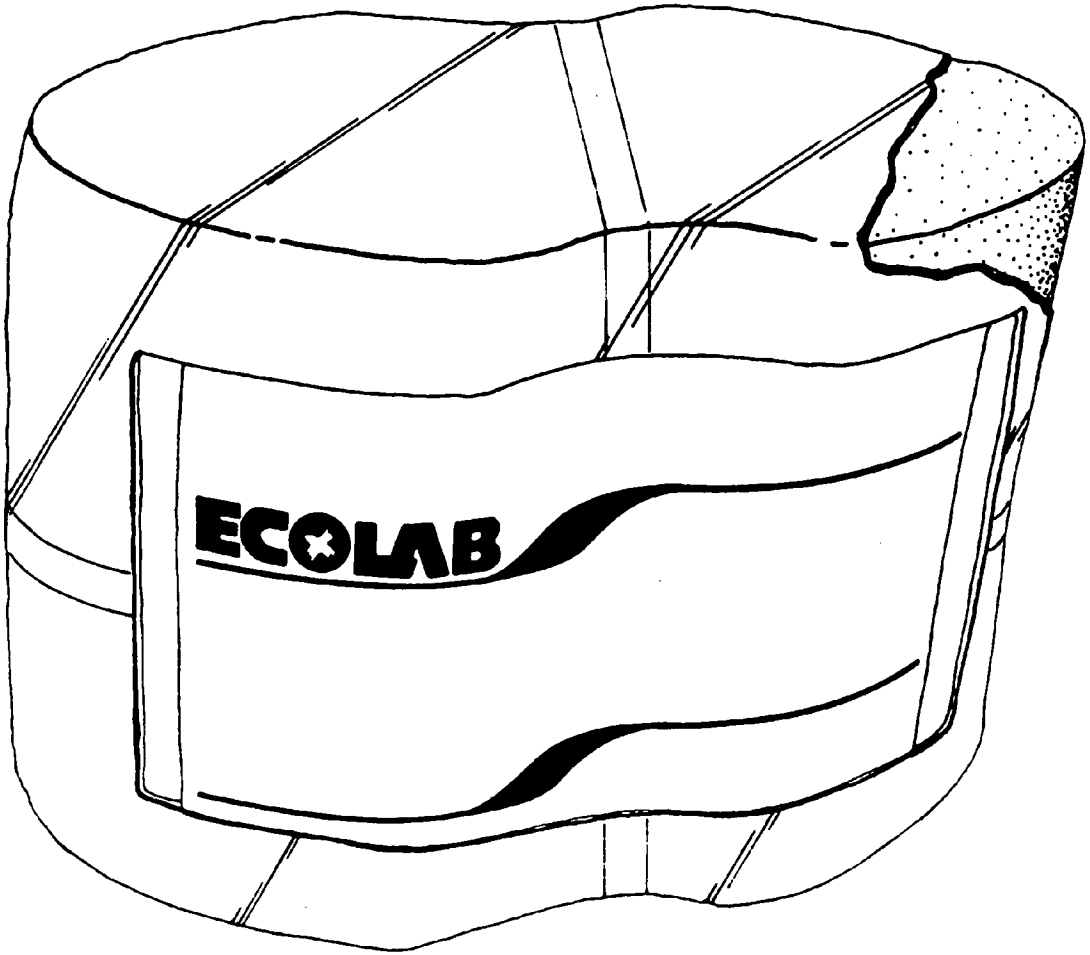
FIG. 9 shows a preferred product shape

The cleaning composition made according to the present invention is dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. A preferred product shape is shown in FIG. 9. When used, the product is removed from the package (e.g.) film and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

The above specification provides a basis for understanding the broad meets and bounds of the invention. The following examples and test data provide an understanding of certain specific embodiments of the invention and contain a best mode. The invention will be further described by reference to the following detailed examples. These examples are not meant to limit the scope of the invention that has been set forth in the foregoing description. Variation within the concepts of the invention are apparent to those skilled in the art.

EXAMPLE 1

The experiment was run to determine the level of water needed to extrude a sodium carbonate product. The product of this example is a presoak but applies equally to a warewash detergent product. A liquid premix was made using water, nonyl phenol ethoxylate with 9.5 moles EO (NPE 9.5), a Direct Blue 86 dye, a fragrance and a Silicone Antifoam 544. These were mixed in a jacketed mix vessel equipped with a marine prop agitator. The temperature of this premix was held between 85-90° F. to prevent gelling. The rest of the ingredients for this experiment were sodium tripolyphosphate, sodium carbonate, and LAS 90% flake which were all fed by separate powder feeders. These materials were all fed into a Teledyne 2" paste processor at the percentages shown in Table 1.

Production rates for this experiment varied between 20 and 18 lbs/minute. The experiment was divided into five different sections, each section had a different liquid premix feed rate, which reduced the amount of water in the formula. The percent of these reductions can be seen on Table 1. Product discharged the Teledyne through an elbow and a 1½" diameter sanitary pipe. Included in Table 1 are the ratios of water to ash for each of the experiments. Also on this table are the results of the experiment, the higher levels of water to ash molar ratios (about 1.8-1.5) produced severe cracking and swelling. Only when levels of water approached 1.3 or less did we see no cracking or swelling of the blocks. Best results were seen at a 1.25 water to ash molar ratio. This shows an example that an extruded ash based product can be made but the water level has to be maintained at lower levels in order to prevent severe cracking or swelling.

TABLE 1

| PATENT EXAMPLES OF A SOLID FUNCTIONAL PRODUCT | | | | | |
|---|---|---|---|---|---|
| | PERCENT | PERCENT | PERCENT | PERCENT | PERCENT |
| PREMIX LIQUID - FIRST LIQUID PORT | | | | | |
| WATER SOFT | 12.1 | 11.2 | 10.1 | 8.9 | 7.6 |
| NonylPhenol Ethoxylate (9.5 mole) | 9.4 | 8.7 | 7.8 | 6.9 | 5.9 |
| DIRECT BLUE 86 | 0.1 | 0.1 | 0.1 | 0.1 | 0.1 |
| FRAGRANCE | 0.3 | 0.3 | 0.2 | 0.2 | 0.2 |
| SILICONE ANTIFOAM 544 | 0.1 | 0.1 | 0.1 | 0.1 | 0.1 |
| POWDERS - FIRST POWDER PORT | | | | | |
| SODIUM TRIPOLY | 33.5 | 34.2 | 35.1 | 36.0 | 37.0 |
| SODIUM CARBONATE | 39.0 | 39.8 | 40.8 | 41.9 | 43.1 |
| LAS 90% FLAKE | 5.5 | 5.7 | 5.8 | 6.0 | 6.1 |
| TOTAL | 100.0 | 100.0 | 100.0 | 100.0 | 100.0 |
| MOLES OF CARBONATE | 0.0037 | 0.0038 | 0.0039 | 0.0040 | 0.0041 |
| MOLES OF WATER | 0.0067 | 0.0062 | 0.0056 | 0.0049 | 0.0042 |
| MOLE RATIO WATER TO ASH | 1.8 | 1.66 | 1.46 | 1.25 | 1.04 |
| RESULTS | BAD/ SWELLED | BAD/ SWELLED | MARGINAL/ SLIGHT SWELLING AND CRACKING | BEST/NO CRACKING OR SWELLING | GOOD/WITH SOME DRY SPOTS/NO CRACKING OR SWELLING |

EXAMPLE 2

The next example is an example of a warewashing detergent produced in a 5" Teledyne paste processor. The premix was made of Surfactant Premix 3 (which is 84% nonionic a pluronic type nonionic and 16% of a mixed mono- and di (about $C_{16}$) alkyl phosphate ester) with large granular sodium tripolyphosphate and spray dried ATMP (aminotri(methylene phosphonic acid). The ATMP sprayed dried was neutralized prior to spray drying to a pH of 12-13. The purpose of this premix is to make a uniform material to be fed to the Teledyne without segregation occurring. The formula for this experiment is as follows:

TABLE 2

| Raw Material Description | Percent (%) |
|---|---|
| Soft Water | 10.972 |
| Nonionic | 3.500 |
| Dense Ash, $Na_2CO_3$ | 49.376 |
| Tripoly, large granular | 30.000 |
| Surfactant | 1.572 |
| Amino tris(methylene phosphonic acid) | 4.500 |
| Dye | 0.080 |

The dye, which is Direct Blue 86 was premixed in the mix tank with the soft water. Production rate for this experiment was 30 lbs/minute and a 350 lb. batch was made. The molar ratio of water to ash was 1.3 for this experiment. The Teledyne process extruder was equipped with a 5½" round elbow and straight sanitary pipe fitting at the discharge. Blocks were cut into approximately 3 lb. blocks. The Teledyne was run at approximately 300 rpm and the discharge pressure was about 20 psi. Water temperature for this experiment was held at 15° C. (59° F.), surfactant temperature was 26° C. (80° F.), and the average block discharge temperature was 46° C. (114° F.). Production ran well with blocks hardening up 15-20 minutes after discharging out of the Teledyne, no cracking or swelling was noted for this experiment.

EXAMPLE 3

Figure 8:
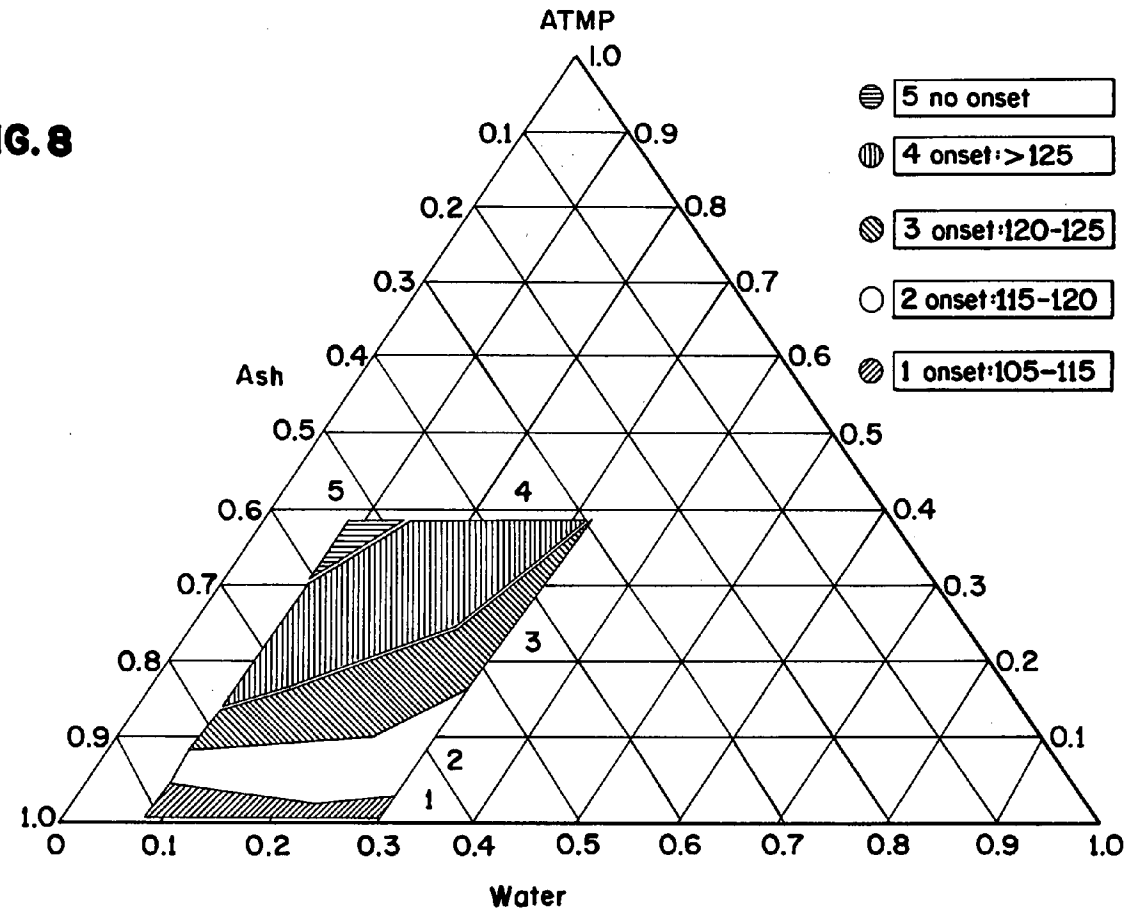

Laboratory samples were made up to determine the phase diagram of ATMP, sodium carbonate and water. The spray dried neutralized version of ATMP used in Example 2 is the same material that is used in this experiment. Anhydrous light density carbonate (FMC grade 100) and water were used for the other ingredients. These mixtures were allowed to react and equilibrate in a 38° C. (100° F.) oven overnight. The samples were then analyzed by DSC to determine the onset of the hydration decomposition spike for each sample. The results of these experiments was a phase diagram which can be seen in FIG. 8. A shift in the onset of the hydrate decomposition temperature as ATMP is added to the mixtures seen. The normal monohydrated ash spike is seen at very low levels of ATMP. But with increased amounts of ATMP, a region of larger proportions of a more stable E-form hydrate binding agent which we believe to be a complex of ATMP, water and ash, is found. We also believe that this is a composition which is responsible for much improved hardens of the blocks with products containing ATMP. The blocks containing ATMP are less likely to crack than blocks not containing ATMP. Also blocks containing ATMP can contain a higher level of water than blocks that do not contain the ATMP.

EXAMPLE 4

For this experiment we ran the same experiment as Example 3 except that Bayhibit AM (which is 2-phosphonobutane-1,2,4-tricarboxylic acid) was substituted for the ATMP. The material used was neutralized to a pH of 12-13 and dried. Mixtures of this material, ash and water, were then prepared and allowed to be equilibrated overnight in a 100° F. oven. Samples were then analyzed by DSC for the onset of hydration decomposition temperature. This system gave comparable results with a higher onset of hydration decomposition.

At this time we believe that an improved extruded ash based solid can be obtained by adding a phosphonate to the formula. We believe that the phosphonates, ash, water E-form complex is the main method of solidification for these systems. This is a superior solidification system to extant monohydrate of ash since it provides a much harder, stronger solid and less prone to cracking and swelling.

Detailed Discussion of the Drawings

FIGS. 1-7 are data demonstrating the existence of the novel E-Form hydrate of the invention and distinguishing the E-Form hydrate from simple sodium carbonate hydrate forms. The existence of the novel hydrate and the differentiation from conventional sodium carbonate hydrates are demonstrated by the differential scanning calorimetry thermograms of the figures.

The differential scanning calorimetry (DSC) thermograms of the product of this invention shows an endotherm peak attributed to the complex at a temperature substantially higher than that expected for ash sodium carbonate monohydrate and other known hydrates. The higher endotherm peak is characteristic of the amorphous complex material comprising carbonate salt, organic phosphonate and water. The amorphous nature of the material has been confirmed by X-ray spectroscopy which shows a lack of crystallinity.

FIG. 1 shows a DSC thermogram of the product containing hydrated complex having a hydration onset temperature of about 134.7° C. and also shows a reference monohydrate of sodium carbonate having an onset hydration peak temperature of about 110.2° C. The difference in onset temperature is clear cut and apparent. We believe this difference in onset temperature demonstrates that a different composition is present in this solid block detergent and that the difference in onset temperatures is due to the presence of a carbonate/phosphonate/water complex material. The term "onset temperature" refers to the temperature in the DSC thermogram which the material either becomes exothermic or endothermic.

Further confirmation of the presence of the carbonate/phosphonate/water complex is obtained by spiking a product containing the complex with known sodium carbonate monohydrate. The results of this experiment is shown in FIG. 2. An endothermic DSC peak due to the 30% sodium carbonate monohydrate spike onset appears at 109.1° C. (characteristic of sodium carbonate monohydrate) as expected, in addition to a peak characteristic of the hydrated complex at an onset of 128.3° C. We have also found that in a solid block having dimensional stability and product integrity, the process conditions are optimized to ensure that little or no sodium carbonate heptahydrate or decahydrate is formed and the solid block detergent is solidified by the presence of the hydrated complex comprising carbonate/phosphonate/water. The organic phosphonate/$H_2O$ molar ratio is important. We believe the best solid material contains about 5-15 moles of water per mole of organic phosphonate. The melting temperature of ash monohydrate is apparently elevated by the water/phosphonate (ATMP) network. We hypothesize that a cage or clathrate structure is formed in which the water and phosphonate cooperate to form a structure surrounding one or more carbonate hydrate molecules. This structure once formed and stabilized has a melting point substantially higher than free carbonate monohydrate. In open pan differential scanning calorimetry, the water in the network evaporates below 80° C. Subsequent to the evaporation, the ash monohydrate can melt at near normal melting temperatures of about 105-110° C. In a sealed DSC pan, water evaporation is suppressed and the networked ash monohydrate typically melts at a temperature of about 130° C. or somewhat higher.

FIG. 3 shows a DSC thermogram of such a dimensionally and physically unstable product with and without spiking with sodium carbonate monohydrate confirming the presence of both the sodium carbonate monohydrate component and the hydrated complex carbonate/phosphonate/water binding agent.

In initial experimentation we have found that the presence of an organic phosphonate aminotrimethylene phosphonate cooperates in the formation of a sodium carbonate hydrate complex formation. In our experimentation we have prepared solutions of sodium carbonate and aminotrimethylene phosphonate at various molar ratios in deionized water. The solutions were dried and the final stoichiometry of sodium carbonate/phosphonate/water for each combination was examined. Attached are photographs (FIG. 6) of complex products made with varying molar ratios of sodium carbonate to phosphonate as indicated. The materials are visually different indicating a change in the materials within the molar ratios shown. We have found that the presence of the organic phosphonate in the hydrated complex carbonate/phosphonate/water binding agent helps retain water by lowering water activity in the complex. Higher levels of phosphonate (see FIG. 4) also increased the rate of drying and is believed to cooperate in the formation of a solid block of sodium carbonate. In the series the combination of five moles of sodium carbonate per mole of phosphonate forms hydrated crystals of the carbonate/phosphonate/water hydrated complex rapidly.

Figure 5:
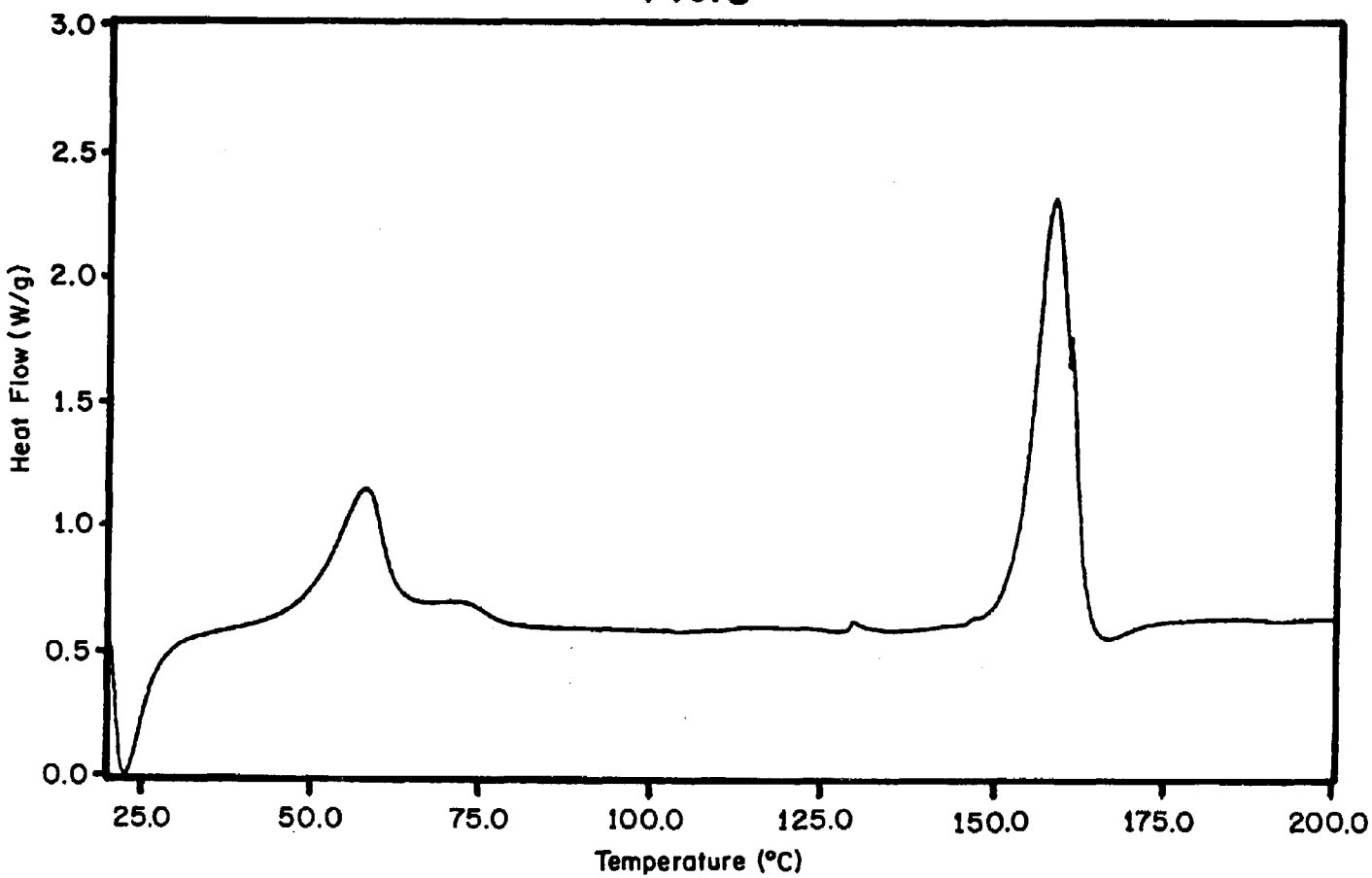
Figure 6A:
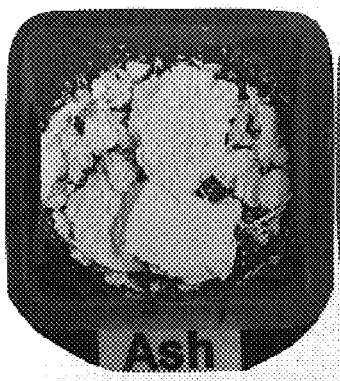
Figure 6B:
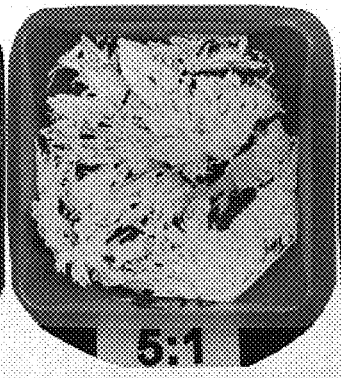
Figure 6C:
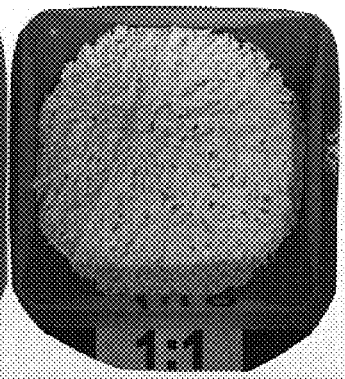
Figure 6D:
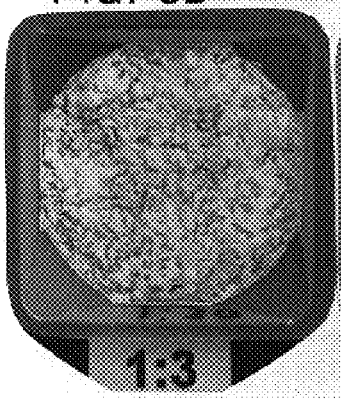
Figure 6E:
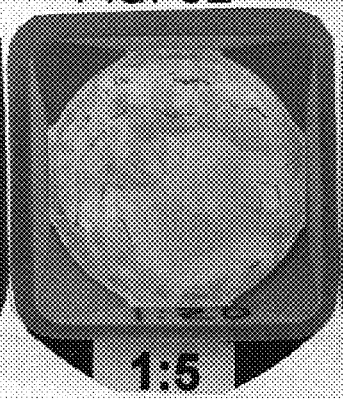
Figure 6F:
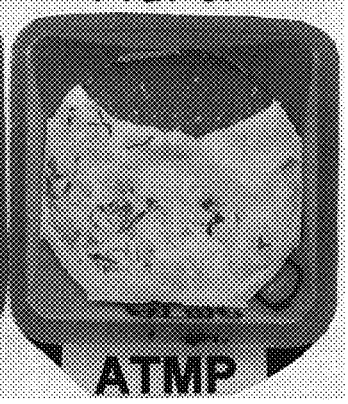
Figure 7:
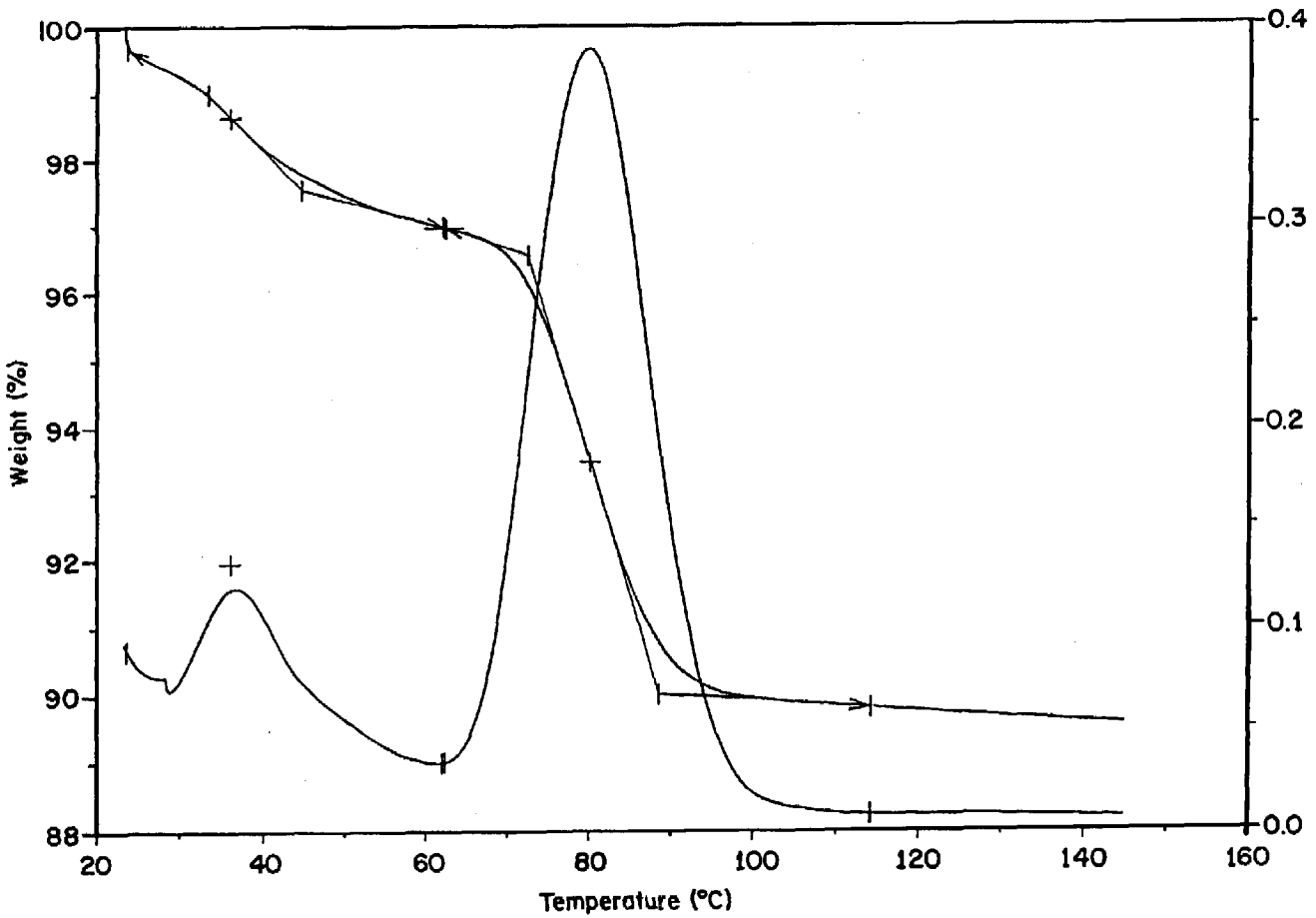

We have also found evidence such as that in FIG. 5, that at different ratios of sodium carbonate to phosphonate, that the complex may have melting points characteristic of different complex ratios. An attached differential scanning calorimetry using a sealed pan having evidence of thermal properties of a complex comprising 5 moles of carbonate with one mole of phosphonate shows a small peak at 133° C. and a large peak at 159° C. These peaks are believed to be representative of complexes with differing ratios of materials. Further, the fate of water added to the blocks may involve complex carbonate/phosphonate/water binding agent or may simply remain as loosely bound water not strongly associated with any component. The thermogravimetric open pan analysis of the product shows two peaks, one peak at about 37° C. shows loosely bound water while the peak at about 80° C. involves the complex formation. The TGA data for the product of the invention shows two states of water in the solid detergent. One state of the water showing a TGA peak at about 40° C. appears to be water associated with a binding agent (2.7 wt. % of the total water). The second state of water appears to be sodium carbonate monohydrate having a melting point of about 80° C. which constitutes about 7.2 wt. % of the cast solid material. Evidence for these states of water is shown in FIG. 7 having two discernible TGA peaks.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An alkaline detergent composition comprising:

(a) an effective amount of a source of alkalinity sufficient to provide soil removal; and (b) a binding agent dispersed throughout the composition, the binding agent comprising: (i) an alkali metal carbonate monohydrate; (ii) an organic sequestrant comprising an aminocarboxylic acid; (iii) and water; wherein in the binding agent, for each mole of the organic sequestrant there is about 3 to 10 moles of the carbonate monohydrate and 5 to 15 moles of water, and the binding agent has a melting transition temperature of greater than about 120° C.

2. The composition of claim 1 wherein the composition further comprises an organo phosphouate.

3. The composition of claim 2 wherein the organo phosphonate comprises amino tri(methylene phosphonic) acid, 1-hydroxyethylidene-1,1-disphosphonic acid, diethylenetriaminopenta(methylene phosphonic) acid, sodium salt thereof, or mixtures thereof.

4. The composition of claim 1 wherein the organic sequestrant comprises diethylcnetriaminepentaacetic acid, N-hydroxyethylaminodiacetic acid, hydroxyethylenediaminetetraacetic acid, N-hydroxyethyliminodiacetic acid, nitrilotriacetic acid, ethylenediaminetetraacetic acid, sodium salt thereof, or mixtures thereof.

5. The composition of claim 1 wherein the composition additionally comprises a builder comprising sodium tripolyphosphate, sodium nitrilotriacetate, or mixtures thereof.

6. The composition of claim 1 wherein the composition additionally comprises a surfactant comprising a nonionic surfactant, an anionic surfactant or mixtures thereof.

7. The composition of claim 1 wherein the binding agent has a melting transition temperature of about 120° C. to 160° C.

8. The composition of claim 1 wherein the composition, other than the binding agent, comprises a carbonate monohydrate and an anhydrous carbonate.

9. The composition of claim 2 wherein the composition comprises a blend of two or more organophosphonate compounds, a blend of two or more aminocarboxylic acid compounds, or a blend of at least one organophosphonate and aminocarboxylic acid.

10. The composition of claim 1 wherein the composition is in the form of a pellet.

11. The composition of claim 1 wherein the composition is in the form of a solid block formed within a container.

12. The composition of claim 1 further comprising about 0.1 to 15 wt. % of a nonionic surfactant, an anionic surfactant, or mixtures thereof.

13. The composition of claim 1 wherein the organic sequestrant comprises N-hydroxyethyl-ethylenediaminetriacetic acid or sodium salt thereof.

14. An alkaline detergent composition comprising:

(a) an effective amount of a source of alkalinity sufficient to provide soil removal; and (b) a binding agent dispersed throughout the composition, the binding agent comprising: (i) an alkali metal carbonate monohydrate; (ii) an organic sequestrant comprising an organo phosphonate or an aminocarboxylic acid; (iii) and water; wherein the binding agent has a melting transition temperature of greater than about 120° C.

the composition being in the form of a cast solid.

15. The composition of claim 14 wherein the organic sequestrant comprises amino tri(methylene phosphonic) acid, 1-hydroxyethylidene-1,1-diphosphonic acid, diethylenetriaminopenta(methylene phosphonic) acid, sodium salt thereof, or mixtures thereof.

16. The composition of claim 14 wherein the organic sequestrant comprises diethylenetriaminepentaaceric acid, N-hydroxyethylaminodiacetic acid, hydroxyethylenediaminetetraacetic acid, N-hydroxyethyliminodiacetic acid, nitrilotriacetic acid, ethylenediaminetetraacetic acid, sodium salt thereof, or mixtures thereof.

17. The composition of claim 14 wherein the organic sequestrant comprises N-hydroxyethyl-ethylenediaminetriacetic acid or sodium salt thereof.

18. The composition of claim 14 wherein the composition further comprising a builder comprising sodium tripolyphosphate, sodium nitrilotriacetate, or mixtures thereof.

19. The composition of claim 14 wherein the composition additionally comprises a surfactant comprising a nonionic surfactant, an anionic surfactant or mixtures thereof.

20. The composition of claim 14 wherein the binding agent has a melting transition temperature of about 120° C. to 1600° C.

21. The composition of claim 14 wherein the composition, other than the binding agent, comprises a carbonate monohydrate and an anhydrous carbonate.

22. The composition of claim 14 wherein the composition is in the form of a high density, fused solid, concrete-like block.

* * * * *